US011231164B2

(12) United States Patent
On et al.

(10) Patent No.: US 11,231,164 B2
(45) Date of Patent: Jan. 25, 2022

(54) HOLIDAY DECORATIVE LAMP

(71) Applicant: Dongguan Kailang Industrial Co., Ltd., Dongguan (CN)

(72) Inventors: Chow Kwok On, Tai Po (CN); Huang Kailang, Dongguan (CN)

(73) Assignee: DONGGUAN KAILANG INDUSTRIAL CO., LTD., Dongguan (CN)

( * ) Notice: Subject to any disclaimer, the term of this patent is extended or adjusted under 35 U.S.C. 154(b) by 0 days.

(21) Appl. No.: 16/864,935

(22) Filed: May 1, 2020

(65) Prior Publication Data

US 2021/0080087 A1 Mar. 18, 2021

(30) Foreign Application Priority Data

Sep. 17, 2019 (CN) ..... 201910875178.3
Sep. 17, 2019 (CN) ..... 201910875470.5

(51) Int. Cl.

| | |
|---|---|
| ***F21V 19/00*** | (2006.01) |
| ***F21V 23/00*** | (2015.01) |
| ***H01R 33/965*** | (2006.01) |
| ***F21V 31/00*** | (2006.01) |
| ***H01R 33/09*** | (2006.01) |

(Continued)

(52) U.S. Cl.

CPC ..... *F21V 19/0025* (2013.01); *F21K 9/90* (2013.01); *F21V 23/002* (2013.01); *F21V 31/00* (2013.01); *H01R 33/09* (2013.01); *H01R 33/965* (2013.01); *F21V 19/0005* (2013.01); *F21W 2121/00* (2013.01); *F21Y 2115/10* (2016.08)

(58) Field of Classification Search

CPC ..... F21V 19/0025; F21V 23/002; F21V 19/0015; F21V 15/00; F21V 17/10; F21V 31/00; F21V 19/00; F21V 19/0005; F21Y 2115/10; F21W 2121/00; F21S 4/00

See application file for complete search history.

(56) References Cited

U.S. PATENT DOCUMENTS

| | | | |
|---|---|---|---|
| 4,244,014 | A | 1/1981 | Van ess |
| 5,001,615 | A | 3/1991 | Stefanelli |

(Continued)

FOREIGN PATENT DOCUMENTS

| | | | |
|---|---|---|---|
| CN | 1624378 | A | 6/2005 |
| CN | 2919011 | Y | 7/2007 |

(Continued)

OTHER PUBLICATIONS

Chinese Patent Office Action for Application No. 201910051551.3 dated Mar. 4, 2020 (10 pages, English translation included).

(Continued)

*Primary Examiner* — Bao Q Truong

(74) *Attorney, Agent, or Firm* — Michael Best & Friedrich LLP

(57) ABSTRACT

A decorative lamp includes a shell and a light emitting body. The shell includes a first end, a second end opposite the first end, and a through hole extending through the first and second ends. The light emitting body is positioned in the through hole of the shell. A first portion of the light emitting body extends into the through hole, and a second portion of the light emitting body extends out of the shell. An outer side wall of the shell includes at least two stepped structures.

20 Claims, 3 Drawing Sheets

(51) Int. Cl.

| | |
|---|---|
| ***F21K 9/90*** | (2016.01) |
| *F21W 121/00* | (2006.01) |
| *F21Y 115/10* | (2016.01) |

(56) References Cited

U.S. PATENT DOCUMENTS

| | | | | |
|---|---|---|---|---|
| 5,685,638 | A | 11/1997 | Huang | |
| 5,709,457 | A | 1/1998 | Hara | |
| 6,250,782 | B1 | 6/2001 | Huang | |
| 6,416,203 | B1 | 7/2002 | Fan Wong | |
| 6,719,441 | B2 | 4/2004 | Wong | |
| 6,921,180 | B2 | 7/2005 | Huang | |
| 8,388,213 | B2 | 3/2013 | Yu | |
| 9,803,851 | B2 | 10/2017 | Loomis et al. | |
| 10,584,865 | B2 | 3/2020 | Loomis et al. | |
| 2004/0017684 | A1 | 1/2004 | Huang | |
| 2006/0062020 | A1* | 3/2006 | Kuo | F21S 4/10 362/654 |
| 2008/0143234 | A1 | 6/2008 | Yu | |
| 2009/0251923 | A1 | 10/2009 | Yu | |
| 2009/0318027 | A1* | 12/2009 | Tseng | F21V 15/01 439/619 |
| 2010/0254161 | A1 | 10/2010 | Lu | |
| 2011/0122613 | A1 | 5/2011 | Hsu | |
| 2011/0221343 | A1* | 9/2011 | Kuo | F21V 23/02 315/41 |
| 2012/0033439 | A1 | 2/2012 | Liu et al. | |
| 2012/0113654 | A1 | 5/2012 | Dai | |
| 2013/0003390 | A1 | 1/2013 | Wu | |
| 2013/0322087 | A1 | 12/2013 | Tseng | |
| 2015/0204524 | A1* | 7/2015 | Pan | F21V 19/0025 313/318.01 |
| 2015/0211727 | A1 | 7/2015 | Loomis et al. | |
| 2020/0224867 | A1 | 7/2020 | Loomis et al. | |
| 2020/0232636 | A1* | 7/2020 | On | F21V 23/002 |

FOREIGN PATENT DOCUMENTS

| | | | |
|---|---|---|---|
| CN | 101055064 | A | 10/2007 |
| CN | 201246726 | Y | 5/2009 |
| CN | 201335326 | Y | 10/2009 |
| CN | 101655227 | A | 2/2010 |
| CN | 202091877 | U | 12/2011 |
| CN | 109915791 | A | 6/2019 |
| CN | 209295040 | U | 8/2019 |

OTHER PUBLICATIONS

United States Patent Office Action for U.S. Appl. No. 16/742,379 dated Jun. 24, 2020 (11 pages).
United States Patent Office Action for U.S. Appl. No. 16/864,930 dated Jan. 1, 2021 (10 pages).
United States Patent Office Action for U.S. Appl. No. 16/742,379 dated Jan. 1, 2021 (17 pages).
United States Patent Office Action for U.S. Appl. No. 16/742,379 dated Apr. 21, 2021 (20 pages).
Chinese Patent Office Action for Application No. 201910051551.3 dated Jul. 10, 2020 (6 pages, statement of relevance included).
Chinese Patent Office Action for Application No. 201910051551.3 dated Oct. 21, 2020 (5 pages, statement of relevance included).
Chinese Patent Office Supplemental Search Report for Application No. 201910051551.3 dated Apr. 6, 2021 (1 page).
Chinese Patent Office Supplemental Search Report for Application No. 201910875178.3 dated Jul. 19, 2020 (1 page).
Chinese Patent Office Supplemental Search Report for Application No. 201910875470.5 dated Apr. 16, 2020 (1 page).
Chinese Patent Office Action for Application No. 201910875470.5 dated Apr. 26, 2020 (5 pages, statement of relevance included).
Chinese Patent Office Action for Application No. 201910875470.5 dated Sep. 9, 2020 (4 pages, statement of relevance included).
United States Patent Office Action for U.S. Appl. No. 16/742,379 dated Oct. 12, 2021 (16 pages).

* cited by examiner

HOLIDAY DECORATIVE LAMP

CROSS-REFERENCE TO RELATED APPLICATIONS

This application claims priority to Chinese Patent Application No. 201910875470.5, filed Sep. 17, 2019, and to Chinese Patent Application No. 201910875178.3, filed Sep. 17, 2019, the entire contents of both of which are incorporated herein by reference.

FIELD

The present disclosure relates to lighting appliances, and more particularly to decorative lamps, such as holiday decorative lamps.

BACKGROUND

Existing decorative lamps on the market may be classified into two types—a contact type and a welding type—according to the electrical connection form of the light emitting body or wick. The contact type, which is a relatively older type, has problems such as the contact points being easily rusted and not durable. The contact type has therefore been largely eliminated in mainstream lamps. The welding type adopts a form of direct electrical conduction. By welding the wire and the pin of the lamp together, after the welding is completed, the combination of the light emitting body and the wire is required to be processed in order to avoid contact damages between the pins. The processing may be performed in several manners, including a shrink type, an injection molded type and a sealed type.

Shrink type processing includes placing an isolation component between two exposed pins to isolate the two exposed pins, and then a shrink sleeve made of a heat-shrinkable material is applied on the outer sides of the pins. The length of the shrink sleeve covers the pins and the exposed wire, and the shrink sleeve is shrunk under heat to tighten the wire and isolation component. It is difficult to automate the shrink type process, however, and the shrink type process is therefore typically used for small batch production.

During injection molded type processing, after the postures of the pin and the wire are adjusted, the pin and the wire are put into an injection mold to be injection molded so that the postures of the pin and the wire are fixed by the injection molded material.

During sealed type processing, the light emitting body is also injection molded so that the light emitting body and the exposed wire are completely sealed in the injection molded material.

Among the above-mentioned three processing manners, the shrink type is limited by the production process and the product quality level is variable, so it is most suitable for small batch machining and can hardly perform automated production. The injection molded type and the sealed type require use of expensive injection molding devices. Decorative lamps are typically inexpensive and may have only seasonal demand, so these costly methods are often infeasible.

SUMMARY

Thus, a need exists for a lamp that can be automatically assembled in the decorative lamp machining industry. The present disclosure provides a decorative lamp that is suitable for automated manufacturing and solves the above-mentioned technical problems.

For example, the present disclosure provides, in one embodiment, a decorative lamp including a shell including a first end, a second end opposite the first end, and a through hole extending through the first and second ends. A light emitting body is positioned in the through hole of the shell. A first portion of the light emitting body extends into the through hole, and a second portion of the light emitting body extends out of the shell. An outer side wall of the shell includes at least two stepped structures configured to position the shell.

Decorative lamps according to various embodiments of the present disclosure may be machined or manufactured in a simplified manner without any heat processing, which facilitates automated assembly. For example, when the lamp is assembled, the light emitting body is inserted into the shell via the through hole from the rear end of the shell, and because the outer side is provided thereon with the stepped structures, during assembly, the shell may be automatically clamped and positioned by means of an apparatus such as a mechanical arm or a fixture to thereby facilitate the mounting of the light emitting body.

In some embodiments, the holiday decorative lamp further includes a decorative accessory coupled to the first end of the shell.

Because the light emitting body is mounted from the rear end of the shell, and part of the structure of the light emitting body extends out from the front end of the shell, the fixed connection between the decorative accessory and the shell will not affect the mounting of the light emitting body.

In some embodiments, each of the at least stepped structures include a clamping face in connection with a positioning face, wherein the positioning face divides the shell into an upper portion and a lower portion, and wherein the clamping face is provided along an outer circumferential side of the upper portion, and a length of the clamping face is greater than or equal to a height of the upper portion.

In some embodiments, the holiday decorative lamp further includes a column positioned below the light emitting body, wherein the column is configured to fix the light emitting body within the shell.

In some embodiments, the column includes a generally cylindrical cross-section and includes two grooves extending through a length of the column.

In some embodiments, the first portion of the light emitting body includes a plurality of pins, wherein the plurality of pins are inserted into the grooves and are separated by the column.

In some embodiments, the holiday decorative lamp further includes a plurality of wires configured to couple the light emitting body to a power supply, wherein the plurality of wires pass through grooves positioned on an inner side of the shell.

The pins are respectively connected to the different wires, so in order to avoid failures due to poor contact or other problems, an isolation means is required to be provided to isolate the different wires and the different pins, and at the same time, the isolation means will not squeeze the pins and the wires. The isolation means is an isolation column with grooves.

In some embodiments, the holiday decorative lamp further includes a tail plug, wherein the plurality of wires pass through recesses positioned on ends of the tail plug, wherein the tail plug includes a size greater than or equal to a size of the through hole.

In some embodiments, the tail plug abuts against a protrusion positioned on the shell.

Because the shell is provided therein with the protrusion, and the tail plug abuts against the protrusion, it indicates that the cross-sectional size of the tail plug is larger than that of the isolation column. In addition, the tail plug tightly matches the through hole of the shell to fix the isolation column and the light emitting body within the shell to prevent them from falling off through the through hole.

In some embodiments, the tail plug includes a recessed positioning member, and an inner side wall of the shell includes a buckling part, wherein the buckling part is configured to engage the positioning member to position the tail plug.

In order to prevent the tail plug from falling off from the shell for being affected by external forces or other reasons, a protruding buckling part is provided on the inner side wall of the shell, a positioning member is provided in a position of the tail plug corresponding to the buckling part, after the tail plug is inserted into the shell, the positioning member corresponds to the buckling part to thereby form a tightly locked structure, and the tail plug is positioned within the shell to prevent the tail plug from falling off.

In some embodiments, the light emitting body is an LED lamp.

In some embodiments, an electrical resistor is positioned between the light emitting body and the plurality of wires.

In some embodiments, the light emitting body and the shell are fixedly connected in an adhering manner.

The present disclosure provides, in another aspect, a decorative lamp including a shell with a through hole and a light emitting body passing through via the bottom of the shell. The end of the light emitting body is located on the upper portion of the shell through the through hole. An isolation column for isolating the pin of the light emitting body and the wire connected to the pin is provided below the light emitting body. The isolation column is completely located within the through hole, and a tail plug that may be tightly connected to the through hole is provided below the isolation column. The tail plug may effectively fix the light emitting body and the isolation column within the shell to thereby ensure the tightness of the mounting. The outer side of the shell is further provided with stepped structures, which may help the automated assembly of the lamp.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. It should be understood that the orientations or positional relationships indicated by the terms "upper", "lower", "front", "rear", "left", "right", "vertical", "horizontal", "top", "bottom", etc. are based on the orientations or positional relationships as shown in FIG. 1, and are only used for conveniently describing the disclosure and simplifying the descriptions, rather than indicating or implying that the devices or elements referred to must have specific orientations or be constructed and operated in specific orientations, and thus cannot be understood as limitations of the disclosure.

DETAILED DESCRIPTION

Figure 1:
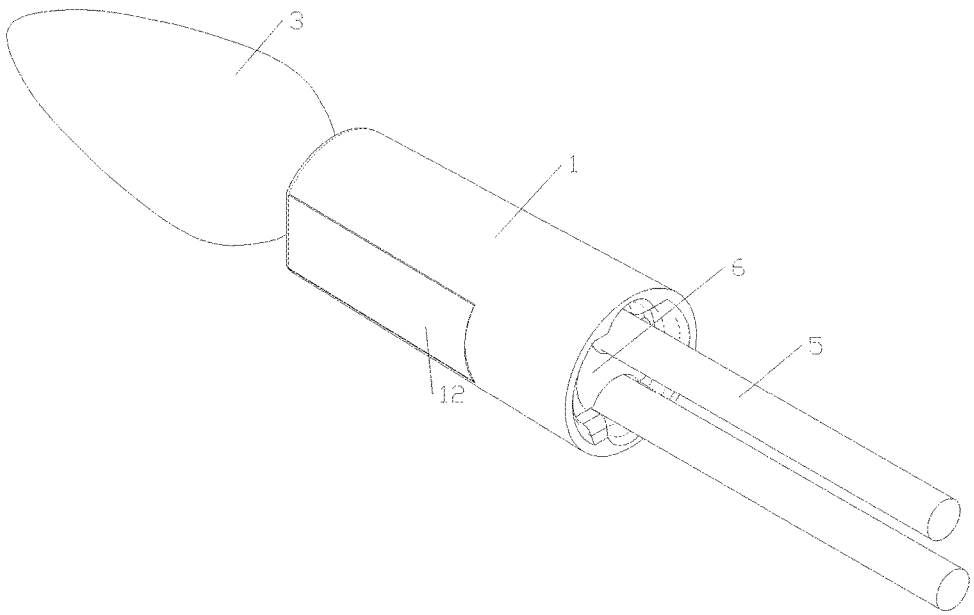
FIG. 1 is a schematic diagram of the overall structure of a holiday decorative lamp according to an embodiment of the disclosure.

FIG. 1 illustrates a decorative lamp, such as a holiday decorative lamp, according to an embodiment of the disclosure. It may be seen from the figure that the lamp as a whole includes two parts, i.e., a decorative accessory and a shell. The decorative accessory may be, for example, a diffuser or shade.

Figure 2:
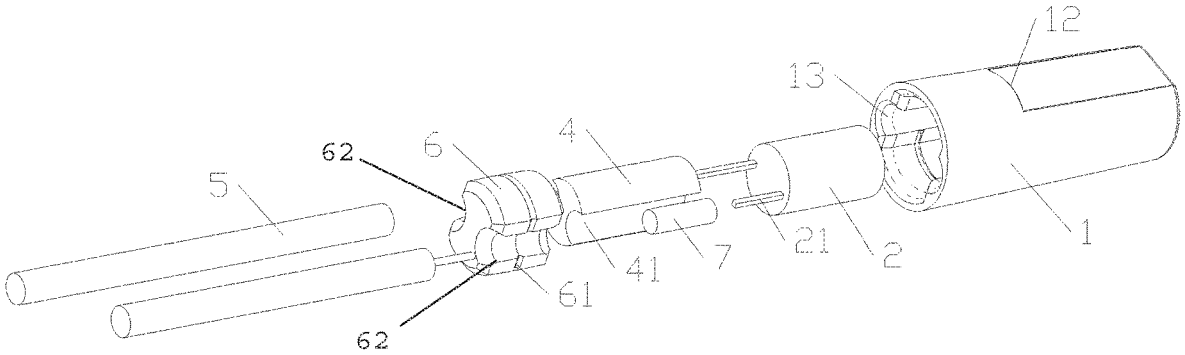
FIG. 2 is an exploded view of the holiday decorative lamp of FIG. 2.

FIG. 2 is an exploded view of the structure of the holiday decorative lamp of the disclosure. In the figure, the decorative accessory part is omitted, and the holiday decorative lamp further comprises a shell, a light emitting body, an isolation column, wires, a tail plug and an electrical resistor.

Figure 3:
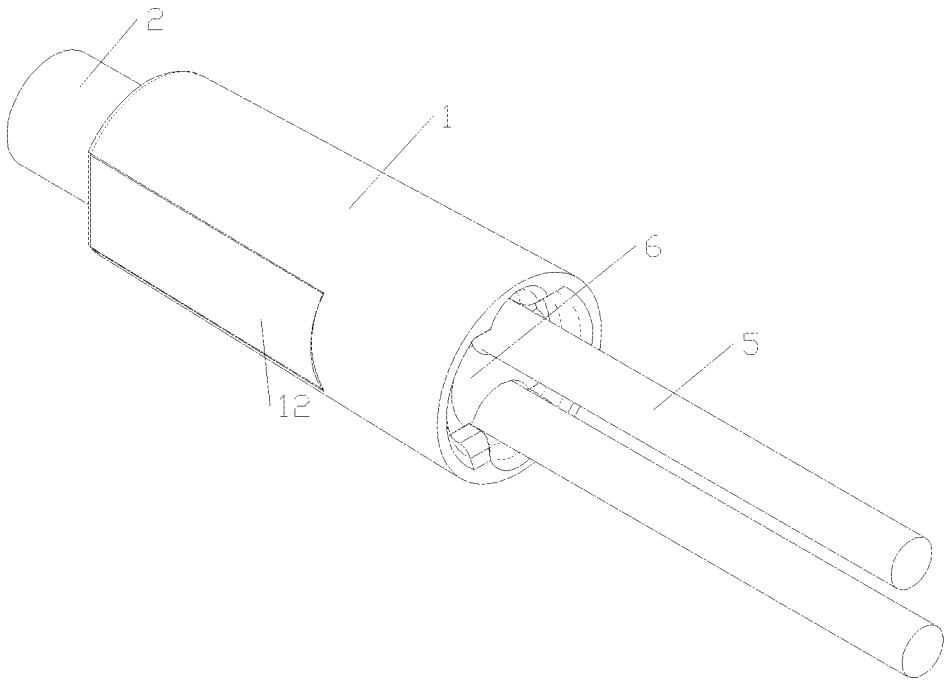
FIG. 3 is a perspective view of an assembly structure of the holiday decorative lamp of FIG. 2.

FIG. 3 is a schematic diagram of the assembly structure of the holiday decorative lamp of the disclosure. In the figure, the end of the light emitting body extends out from the shell, and the tail plug and the wire extending out of the shell through the tail plug may be seen on the other side of the shell.

Figure 4:
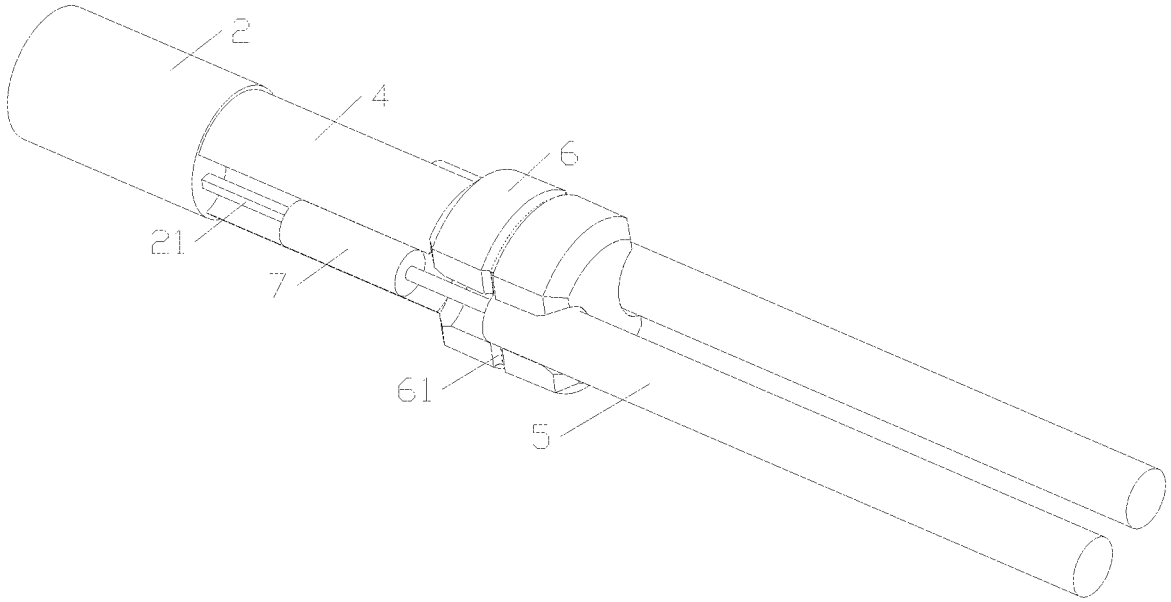
FIG. 4 is a partially exploded view illustrating the assembly structure of FIG. 3.

FIG. 4 is a schematic diagram of the internal assembly structure of the holiday decorative lamp of the disclosure. It may be seen from the figure that the light emitting body, the wires and the electrical resistor are connected in a certain sequence, the isolation column isolates the pins at the lower end of the light emitting body and the wires, the tail plug is located below the isolation column, the cross-sectional shapes of the two are substantially similar, but the cross-sectional size of the tail plug is larger than the cross-sectional size of the isolation column.

Figure 5A:
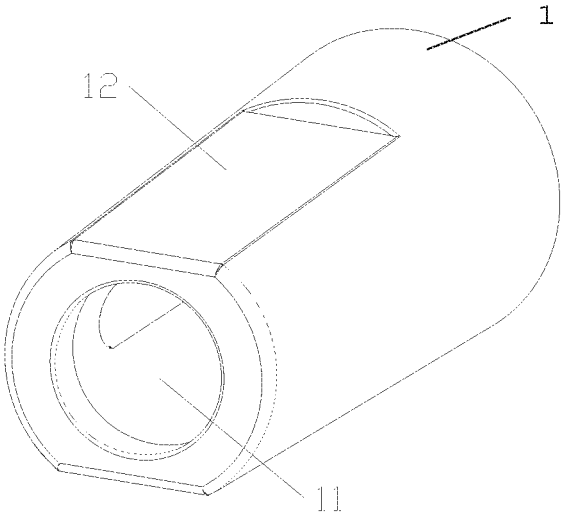
FIG. 5A is a perspective view illustrating a shell of the assembly structure of FIG. 3.
Figure 5B:
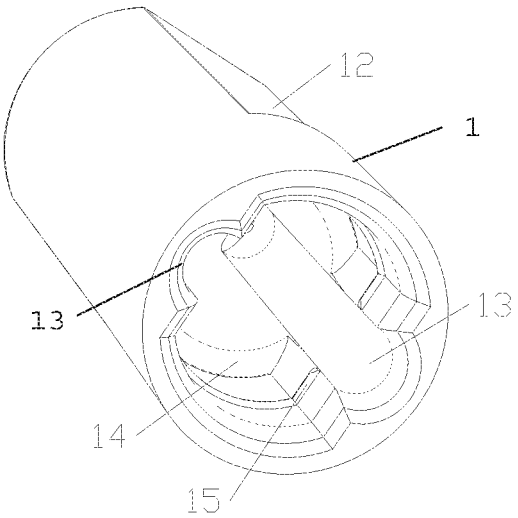
FIG. 5B is another perspective view of the shell of FIG. 5A.

FIG. 5A is a schematic diagram of the structure of the shell as viewed from the front, and FIG. 5B is a schematic diagram of the structure of the shell as viewed from the rear. It may be seen from the figure that the shell is provided therein with grooves for the wires to extend out and a protrusion abutting against the tail plug.

Figure 6:
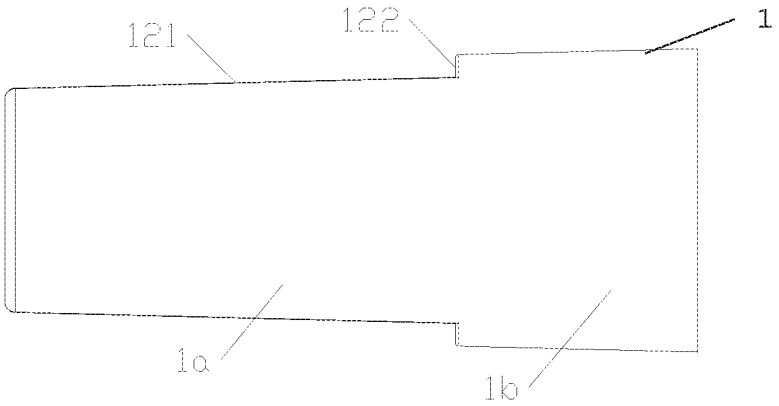
FIG. 6 is a side view of the shell of FIG. 5A.

FIG. 6 is a side view of the shell in FIG. 2. It may be clearly seen from the figure that the exterior of the shell is provided with two stepped structures, and the two stepped structures are oppositely provided.

As shown in FIGS. 1-6, the disclosure provides a decorative lamp (e.g., a holiday decorative lamp) including a wick or light emitting body 2, which is an LED in the illustrated embodiment, a shell 1, and a decorative accessory 3 coupled to the shell 1. The shell 1 includes a through hole 11 that extends through front and rear ends of the shell 1 so that the shell 1 forms a hollow structure. The light emitting body 2 is provided at the front end of the shell 1 through the rear end of the shell 1 via the through hole 11, at the same time, the bottom of the light emitting body 2 is located within the through hole 11, and the remaining part extends out from the front end part of the shell 1 along the through hole 11. Because the light emitting body 2 is inserted into the shell 1 from the rear end of the shell 1, the decorative accessory 3 and the shell 1 may be coupled together during assembly before the light emitting body 2 is inserted into the shell. This advantageously facilitates manufacturing and assembly of the decorative lamp.

As shown in FIG. 1, the shell 1 and the decorative accessory 3 are fixedly connected. In some embodiments, the decorative accessory 3 is tightly connected to the shell 1 through the front end of the shell 1 to form a matching structure for sealed engagement. The decorative accessory 3 may be a lampshade, diffuser, or a decorative piece provided at the front end of the light emitting body 2. The shape of the decorative piece may be, for example, an animal silhouette or another shape, and it may be fixed at an outer circumferential side of the front end of the shell 1, or fixed at a side of the front end of the shell 1 as long as it may play a decorative role.

Because the light emitting body 2 is mounted from the rear end of the shell 1, and part of the structure of the light emitting body 2 extends out from the front end of the shell 1, the connection between the decorative accessory 3 and the shell 1 does not affect the mounting of the light emitting body 2. This further facilitates the reduction of the assembly difficulty and the reduction of the number of the assembly steps.

In some embodiments, the shell 1 may be fixed by a clamping fixture or other jig to facilitate assembly of the decorative lamp. As shown in FIGS. 5A-6, the shell 1 includes steps 12 provided on the outer circumferential wall of the shell 1. The number of the steps 12 may be one, two, three or more. The steps 12 may be evenly distributed on the outer circumferential wall of the shell 1 or may be arranged on the outer circumferential wall of the shell 1 in other ways.

Each of the steps 12 includes a clamping face 121 and a positioning face 122 that are connected, wherein the positioning face 122 divides the shell 1 into a first or upper portion 1*a* and a second or lower portion 1*b*. The clamping face 121 is provided along the outer circumferential side of the upper portion 1*a*, and the length of the clamping face 121 is greater than or equal to the height of the upper portion 1*a*. An outer surface of the clamping face 121 may be planar or curved with a fixed arc, and may be further provided with a structure, such as a groove or a wave pattern, as long as it may meet requirements for assembly.

The outer side structure of the shell 1 is cylindrical, or a truncated cone structure. An angle between the clamping face 121 and the positioning face 122 may be greater than or equal to 90 degrees. Specifically, the width of the positioning face 122 is between 0.3 cm and 1.2 cm, and the optimal width is 0.8 cm in some embodiments.

The illustrated light emitting body 2 is a light emitting diode, such as, an LED lamp. Thus, pins 21 are provided below the light emitting body 2. The diameter of the LED lamp is greater than or equal to 3 mm, and the diameter of 5 mm is preferred. The number of the pins 21 may be two, three or four. In the illustrated embodiments, the light emitting body 2 includes two pins. However, the light emitting body 2 may include additional or fewer pins 21.

The pins 21 are respectively connected to a power supply through the wires 5. Therefore, the pins 21 are respectively connected to the different wires 5. In order to avoid failures due to poor contact or other problems, an isolation means is required to be provided to isolate the different wires 5 and the different pins 21, and at the same time, the isolation means will not jam the pins 21 and/or the wires 5.

In the illustrated embodiment, the isolation means includes an isolation column 4, which is a strip-shaped structure, and is located below the light emitting body 2. The isolation column 4 includes a curved cross-section, in which two opposite side faces are recessed inwards to form two opposite strip-shaped grooves. The strip-shaped groove 41 is provided along a length direction of the isolation column 4. When the isolation column 4 is connected to the light emitting body 2, the pins 21 are respectively inserted into the strip-shaped grooves 41 so as to be separated by the isolation column 4, and the wire 5 connected to the pin 21 is also isolated via the isolation column 4. Additionally, the isolation column 4 fixes the light emitting body 2 within the shell 1 to prevent the light emitting body 2 from falling off from the shell 1.

In some embodiments, an electrical resistor 7 is further provided between the light-emitting body 2 and the wire 5. In other embodiments, the electrical resistor 7 may be omitted, and/or other electrical components may be provided between the light emitting body 2 and the wire 5.

In order to ensure that the isolation column 4 and the light emitting body 2 are firmly mounted within the shell 1, a sealing means is positioned at a lower end of the shell 1. For example, in the illustrated embodiment, the sealing means includes a tail plug 6, and both sides of the tail plug 6 are provided with recesses for the wire 5 to pass through. A size of the tail plug 6 is greater than or equal to the size of the through hole 11, so that the tail plug 6 forms a snug fit with the shell 1. In some embodiments, the shell 1 is elastic (e.g., made of an elastic material such as a flexible plastic material), which facilitates forming a snug fit when the tail plug 6 is inserted into the shell 1. That is, the shell 1 may deform slightly upon insertion of the tail plug 6 into the shell 1.

The tail plug 6 also has a larger diameter or maximum cross-sectional dimension than the isolation column 4. The shell 1 includes an inner wall 14 that acts as a stop when the tail plug 6 is inserted into the shell 1. In addition, the tail plug 6 snugly fits within the through hole 11 of the shell 1 to fix the isolation column 4 to the light emitting body 2 within the shell 1.

In some embodiments, in order to ensure the fixation of the tail plug 6, the inner side wall of the shell 1 may include a protruding ridge 15. The outer side of the tail plug 6 includes a circumferential groove 61 that is recessed inwards. When the tail plug 6 is inserted into the shell 1 along the inner side wall of the shell 1 via the through hole 11, the ridge 15 enters the groove 61 to form a tightly locked structure or snap fit. This prevents the tail plug 6 from slipping out of the through hole 11.

In order to ensure that the wires 5 will not be jammed by the tail plug 6, the inner side of the shell 1 may be provided with grooves 13 for the wires 5 to pass through and engage. The position of the grooves 13 corresponds to the positions of the recesses of the tail plug 6.

In addition to the light emitting body 2 being fixed through the tail plug 6 and the isolation column 4, the light emitting body 2 may additionally be fixedly connected to the inner side wall of the shell 1 in a tightly matching or adhering manner. To be specific, before the light emitting body 2 and the shell 1 are assembled, glue may be applied to a the outer circumferential side of the light emitting body 2, and then the light emitting body 2 is mounted on the shell 1 to achieve the fixation and mounting of the light emitting body 2.

In order to ensure that the wires 5 will not be jammed by the tail plug 6, the inner side of the shell 1 may be provided with grooves 13 for the wires 5 to pass through and engage. The position of the grooves 13 corresponds to the positions of corresponding grooves 62 in the tail plug 6. That is, when assembled, the grooves 62 and the grooves 13 are each aligned and form circular tracks that receive the respective wires 5.

The wires 5 fit within the grooves 62, 13 when the tail plug 6 is coupled to the mounting shell 1, therefore forming a sealed structure at the end of the decorative lamp, which facilitates waterproofing and air isolation. The snap fit of the tail plug 6 into the mounting shell 1 advantageously provides a strong fastening performance and is convenient for both assembly (e.g., facilitating automatic assembly) while also being able to be disassembled for maintenance.

The components required by the lamp are as shown in FIG. 2, and the assembled structure of the lamp is as shown in FIGS. 3-4.

The contents stated above are only specific implementation modes of the disclosure, but the scope of protection of the disclosure is not limited thereto. Any changes or substitutions that may be easily conceived by those skilled in the art within the technical scope disclosed in the disclosure shall be covered by the scope of protection of the disclosure.

Various features and aspects of the present disclosure are set forth in the following claims.

What is claimed is:

1. A decorative lamp comprising:

a flexible shell including a first end, a second end opposite the first end, and a through hole extending through the first and second ends;

a light emitting body positioned in the through hole of the flexible shell; and a tail plug removably positioned within the through hole adjacent the first end of the flexible shell, wherein the tail plug has a diameter greater than a diameter of the through hole, wherein the tail plug and flexible shell are configured such that the flexible shell deforms upon insertion of the tail plug, wherein a first end of the light emitting body is positioned in the through hole, and a second end of the light emitting body extends out from the second end of the flexible shell, wherein an outer surface of the flexible shell includes a stepped structure, and wherein the flexible shell is configured such that the second end of the light emitting body is installed through the first end of the flexible shell.

2. The decorative lamp of claim 1, further comprising a decorative accessory coupled to the second end of the flexible shell, the decorative accessory selected from the group consisting of: a lampshade, a diffuser, and a decorative piece.

3. The decorative lamp of claim 1, wherein the stepped structure includes a clamping face and an adjacent positioning face, wherein the positioning face divides the flexible shell into a first portion and a second portion, wherein the clamping face is provided along an outer circumferential side of the first portion.

4. The decorative lamp of claim 1, further comprising a column positioned between the first end of the light emitting body and an end of tail plug.

5. The decorative lamp of claim 4, wherein the column includes a plurality of grooves formed in an outer surface of the column and extending a length of the column.

6. The decorative lamp of claim 1, further comprising a column positioned between the first end of the light emitting body and an end of the tail plug, wherein the first end of the light emitting body includes a plurality of pins, and wherein the plurality of pins are received in a corresponding plurality of grooves formed in an outer surface of the column and the pins of the plurality of pins are separated by the column.

7. The decorative lamp of claim 1, further comprising a plurality of wires configured to couple the light emitting body to a power supply, wherein the plurality of wires are at least partially received in a corresponding first plurality of grooves formed on an inner surface of the flexible shell.

8. The decorative lamp of claim 7, wherein the plurality of wires are at least partially received in a corresponding second plurality of grooves formed in the tail plug.

9. The decorative lamp of claim 8, further comprising a column positioned between the first end of the light emitting body and an end of the tail plug, wherein the tail plug is configured to be inserted into the shell independently of the column.

10. The decorative lamp of claim 1, wherein the tail plug includes a circumferential groove, and an inner surface of the flexible shell includes a ridge, wherein the ridge is configured to engage the circumferential groove to secure the tail plug to the flexible shell.

11. The decorative lamp of claim 7, further comprising an electrical resistor positioned between the light emitting body and the plurality of wires.

12. A decorative lamp comprising:

a shell including a first end, a second end opposite the first end, a through hole extending through the first and second ends, and a first plurality of grooves formed in an inner surface of the shell;

a light emitting body having a first end and a second end opposite the first end, wherein the first end of the light emitting body is positioned within the through hole in the shell with the second end of the light emitting body extending from the second end of the shell, and wherein the shell is configured such that the second end of the light emitting body is installed through the first end of the shell;

a plurality of pins coupled to the first end of the light emitting body;

a plurality of wires corresponding and coupled to the plurality of pins;

a column having a first end and an opposite second end, wherein the column is positioned adjacent the first end of the light emitting body and between the plurality of pins, wherein the column has a second plurality of grooves formed in an outer surface of the column, wherein each groove of the second plurality of grooves extends from the first end to the second end of the column and is configured to receive one of the pins of the plurality of pins and separate the pins of the plurality of pins from one another, and wherein the first plurality of grooves and the second plurality of grooves are aligned to form tracks configured to receive the plurality of pins coupled to the light emitting body; and a tail plug configured to be inserted into the shell independently of the column, wherein the tail plug is positioned adjacent the first end of the column opposite the light emitting body, the tail plug having a third plurality of grooves, wherein each groove of the plurality of grooves is configured to receive one of the wires of the plurality of wires and separate the wires of the plurality of wires from one another, and wherein the third plurality of grooves is aligned with both the first plurality of grooves and the second plurality of grooves to form tracks, and wherein the tail plug has a diameter greater than a diameter of the through hole.

13. The decorative lamp of claim 12, wherein the tail plug abuts against the inner wall of the shell.

14. The decorative lamp of claim 12, wherein the tail plug includes a circumferential groove, and the inner surface of the shell includes a ridge, wherein the ridge is configured to engage the circumferential groove in a snap fit to secure the tail plug to the shell.

15. The decorative lamp of claim 12, wherein the tail plug abuts against a stop formed on the inner surface of the shell.

16. The decorative lamp of claim 12, wherein an outer surface of the shell includes at least two stepped structures.

17. The decorative lamp of claim 12, wherein the shell is formed from a flexible material such that the shell deforms upon insertion of the tail plug.

18. The decorative lamp of claim 12, wherein the light emitting body is adhered to the inner surface of the shell.

19. The decorative lamp of claim 12, wherein the shell comprises an outer wall formed as a truncated cone.

20. A decorative lamp, comprising:

a shell including a first end, a second end opposite the first end, and a through hole extending through the first and second ends, wherein an outer side wall of the shell includes at least two stepped structures;

a light emitting body positioned in the through hole of the shell, wherein a first portion of the light emitting body extends into the through hole, and a second portion of the light emitting body extends out of the shell;

a plurality of wires configured to couple the light emitting body to a power supply, wherein the wires are at least partially received in a first plurality of grooves formed on an inner side of the shell; and a tail plug, wherein the wires are at least partially received in a second plurality of grooves formed in the tail plug, wherein the tail plug includes a diameter greater than or equal to a diameter of the through hole and abuts against an internal wall within the shell, wherein the tail plug includes a circumferential groove, and an inner side wall of the shell includes a ridge, and wherein the ridge is configured to engage the circumferential groove to secure the tail plug to the shell.

* * * * *